US007691037B1

(12) United States Patent
Huynh

(10) Patent No.: US 7,691,037 B1
(45) Date of Patent: Apr. 6, 2010

(54) EXERCISE AND MUSCLE TONING DEVICE AND ASSOCIATED METHOD

(76) Inventor: Tam Thi Huynh, 7515 Summer shore drive, Rosenberg, TX (US) 77469

( * ) Notice: Subject to any disclaimer, the term of this patent is extended or adjusted under 35 U.S.C. 154(b) by 0 days.

(21) Appl. No.: 12/150,299

(22) Filed: Apr. 28, 2008

(51) Int. Cl.
*A63B 21/02* (2006.01)

(52) U.S. Cl. ..... 482/123

(58) Field of Classification Search ..... 482/142, 482/148, 121–130; 446/220
See application file for complete search history.

(56) References Cited

U.S. PATENT DOCUMENTS 2,147,958 A * 2/1939 Angers ..... 297/301.4
2,952,856 A * 9/1960 Ruff ..... 5/640
5,335,968 A * 8/1994 Sheridan et al. ..... 297/250.1
5,687,438 A * 11/1997 Biggie et al. ..... 5/654
6,152,530 A 11/2000 Hsu
6,328,385 B1 * 12/2001 Lau ..... 297/452.41
6,786,555 B2 * 9/2004 Brook ..... 297/452.41

* cited by examiner

*Primary Examiner*—Lori Baker

(57) ABSTRACT

An exercise and muscle toning apparatus includes a first inflated spherical balloon adapted to hold a predetermined volume of air for providing resilient support, a second inflated spherical balloon adapted to hold a predetermined volume of air for providing resilient support, and a contoured chair adjustably and removably positioned on the first and second spherical balloons in such a manner that a back portion of the contoured chair conforms to a curvilinear circumference of the first spherical balloon while a seat portion of the contoured chair conforms to a curvilinear circumference of the second spherical balloon. The exercise and muscle training apparatus further includes hook and loop fasteners and a mechanism for preventing the first and second spherical balloons from separating beyond a maximum spatial distance.

10 Claims, 6 Drawing Sheets

EXERCISE AND MUSCLE TONING DEVICE AND ASSOCIATED METHOD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to exercise devices and, more particularly, to an exercise and muscle toning device that employs two inflatable balls and a support chair in cooperation therewith.

2. Prior Art

Due to increased public interest in fitness and health, a great variety of exercise equipment has been designed in recent years. Most exercise equipment includes a weight-resistance apparatus, a cycle apparatus, or both. Most of these prior art exercise devices are large and bulky and thus require a significant amount of floor space. Moreover, prior art equipment is typically manufactured with numerous moving parts formed of tubular steel or rubber and is thus unsightly. Accordingly, most prior art exercise equipment is primarily designed to be used in commercial fitness centers. Since many users are too busy to travel to fitness centers, commercial exercise equipment is often underutilized.

To meet the demand for more convenient exercise equipment, manufacturers have designed smaller units for residential use. Although these prior art devices are more convenient than large commercial devices, they suffer from many of the same limitations. For example, prior art residential exercisers are unattractive and too large to be placed in living areas of the home. Thus, the equipment is relegated to the basement where it is either used infrequently or totally forgotten.

U.S. Pat. No. 6,152,530 to Hsu discloses an article of inflatable furniture having independent air chambers for supporting body weight and typically used in the domestic environment, which includes a plurality of air pressurized subchambers particularly positioned within an outer enclosing chamber for modifying the shape of the outer enclosing chamber to obtain a cushioned, roll-up effect in the article of furniture. The article of inflatable furniture includes a bottom layer and a pressurized outer enclosing chamber sealed to the bottom layer. A seating surface is formed on the outer enclosing chamber for supporting the body weight of a person. A pair of independent, air pressurized subchambers is sealed to the bottom layer and extends upward into the outer enclosing chamber. The subchambers serve to increase the pressure within the outer enclosing chamber and to modify the shape of the outer enclosing chamber. A first alternative embodiment teaches the construction as applied to an inflatable sofa while a second alternative embodiment teaches the construction as applied to an inflatable mattress. Unfortunately, this prior art example does not enable a user to achieve an optimal workout while they watch television.

U.S. Pat. No. 6,328,385 to Lau discloses an inflatable chair with an outer chamber that defines the shape and size of the chair, and at least one support section positioned inside the outer chamber. The support section(s) provide the desired support at particular locations of the outer chamber so as to provide the necessary comfort and stability to the chair. Unfortunately, this prior art example does not eliminate the need for other workout regimens and trips to the gym.

U.S. Pat. No. 6,786,555 to Brook discloses a convertible inflatable furnishing. The furnishing can form a chair shape that can be converted into a supportive shape for massage and stretching by deflating and securing the backrest inside the furnishing. The chair is also capable of being rocked, reclined, and packed into itself. Unfortunately, this prior art example is not designed for allowing virtually any consumer to tone areas of the body at any time of day.

Accordingly, the present invention is disclosed in order to overcome the above noted shortcomings. The exercise and muscle toning apparatus is convenient and easy to use, lightweight yet durable in design, and designed for exercising and toning user muscles. The apparatus is simple to use, inexpensive, and designed for many years of repeated use.

BRIEF SUMMARY OF THE INVENTION

In view of the foregoing background, it is therefore an object of the present invention to provide an apparatus for exercising and toning user muscles. These and other objects, features, and advantages of the invention are provided by an exercise and muscle toning apparatus.

An exercise and muscle toning apparatus includes a first inflated spherical balloon effectively adapted to hold a predetermined volume of air for providing resilient support, and a second inflated spherical balloon adapted to hold a predetermined volume of air for providing resilient support. Such a second spherical balloon has a smaller diameter than a diameter of the first spherical balloon, and the second spherical balloon is positioned anterior of the first spherical balloon.

The apparatus further includes a contoured chair adjustably and removably positioned on the first and second spherical balloons in such a manner that a back portion of the contoured chair conveniently conforms to a curvilinear circumference of the first spherical balloon while a seat portion of the contoured chair conforms to a curvilinear circumference of the second spherical balloon. Such a chair further includes a plurality of handles statically coupled to the back and seat portions for maintaining the back and seat portions at a fixed relationship. The back portion is pivotally coupled to the seat portion, and the first and second spherical balloons are freely rotated on a ground surface when a user body is shifted along a tangential direction to the circumference of the first and second spherical balloons respectively.

The exercise and muscle training apparatus further includes hook and loop fasteners attached to an outer surface of one of the first and second spherical balloons as well as a bottom surface of one of the back and seat portions of the contoured chair for removably attaching the contoured chair to the one spherical balloon respectively and thereby prohibiting the contoured chair from disengaging the one spherical balloon. The apparatus also includes a mechanism for advantageously preventing the first and second spherical balloons from separating beyond a maximum spatial distance from each other such that the first and second spherical balloons are automatically reciprocated towards each other after being separated beyond a threshold spatial distance.

Such a separation preventing mechanism includes a first resilient spring member with first and second opposed ends directly coupled to the outer surface of the first and second spherical balloons respectively. A second resilient spring member has first and second opposed ends directly coupled to the outer surface of the first and second spherical balloons respectively. Such first and second resilient spring members effectively converge forwardly towards the second spherical balloon for providing angularly offset resistive forces directed towards a center of the second spherical balloon and thereby ensuring that a center of the second spherical balloon is aligned with a center of the first spherical balloon during equilibrium.

A method for exercising and toning user muscles includes the steps of: providing a first inflated spherical balloon adapted to hold a predetermined volume of air for providing resilient support; providing a second inflated spherical balloon adapted to hold a predetermined volume of air for providing resilient support; positioning the second spherical balloon anterior of the first spherical balloon; providing a contoured chair; adjustably and removably positioning the chair on the first and second spherical balloons in such a manner that a back portion of the contoured chair conforms to a curvilinear circumference of the first spherical balloon while a seat portion of the contoured chair conforms to a curvilinear circumference of the second spherical balloon; a user sitting on the chair; the user leaning back against the back portion; and freely rotating the first and second spherical balloons on a ground surface by shifting a user body along a tangential direction to the circumference of the first and second spherical balloons respectively.

The method further includes the step of: attaching hook and loop fasteners to an outer surface of one of the first and second spherical balloons as well as a bottom surface of one of the back and seat portions of the contoured chair; preventing the first and second spherical balloons from separating beyond a maximum spatial distance from each other; and automatically reciprocating the first and second spherical balloons towards each other after being separated beyond a threshold spatial distance.

The method further includes the steps of: providing and directly coupling first and second opposed ends of a first resilient spring member to the outer surface of the first and second spherical balloons respectively; providing and directly coupling first and second opposed ends of a second resilient spring member to the outer surface of the first and second spherical balloons respectively such that the first and second resilient spring members converge forwardly towards the second spherical balloon; and ensuring that a center of the second spherical balloon is aligned with a center of the first spherical balloon during equilibrium by providing angularly offset resistive forces directed towards a center of the second spherical balloon.

The method further includes the step of: pivotally coupling the back portion to the seat portion; and providing and statically coupling a plurality of handles to the back and seat portions for maintaining the back and seat portions at a fixed relationship.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
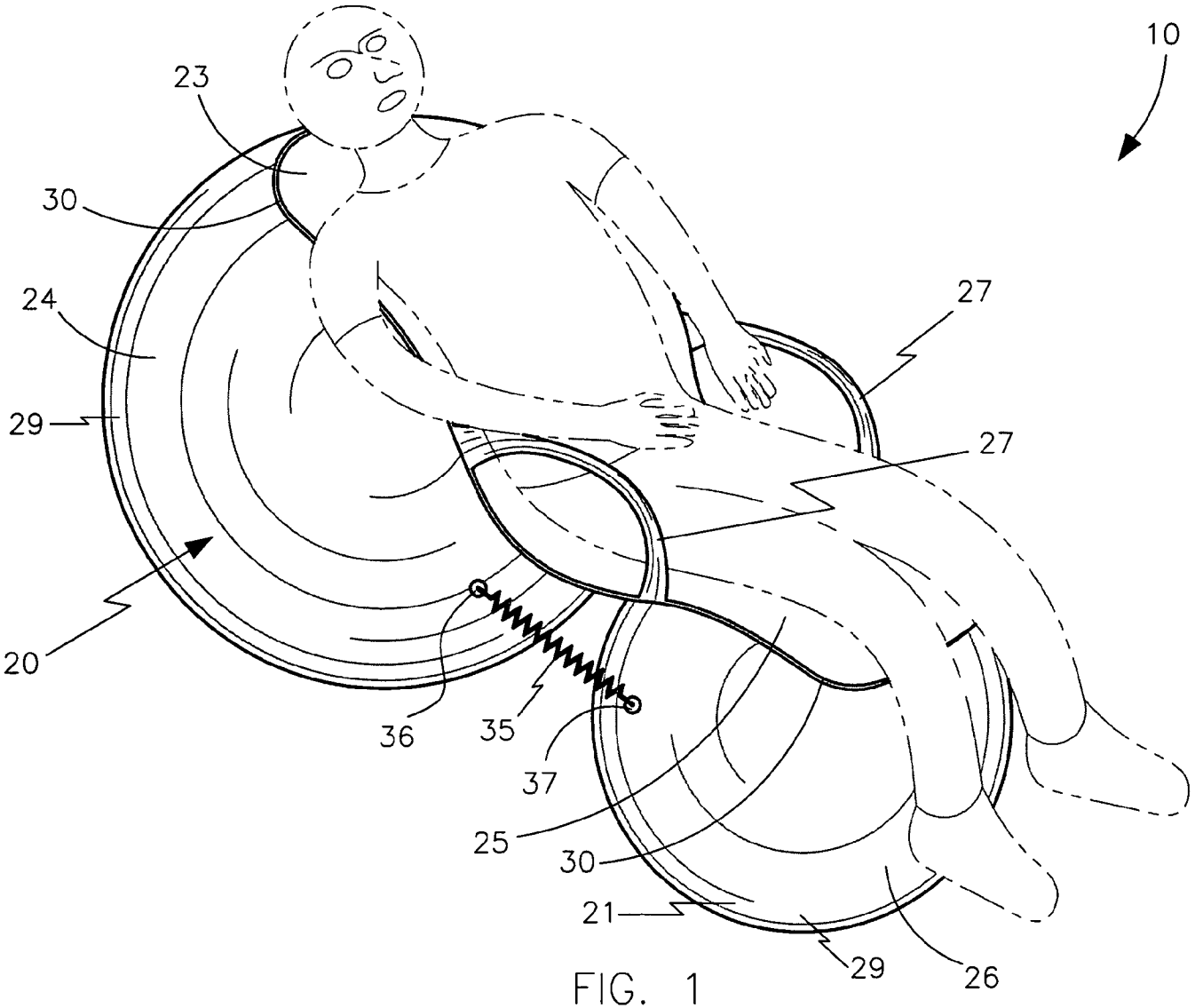
FIG. 1 is a perspective view showing a first embodiment of an exercise and muscle toning apparatus in use, in accordance with the present invention.
Figure 2:
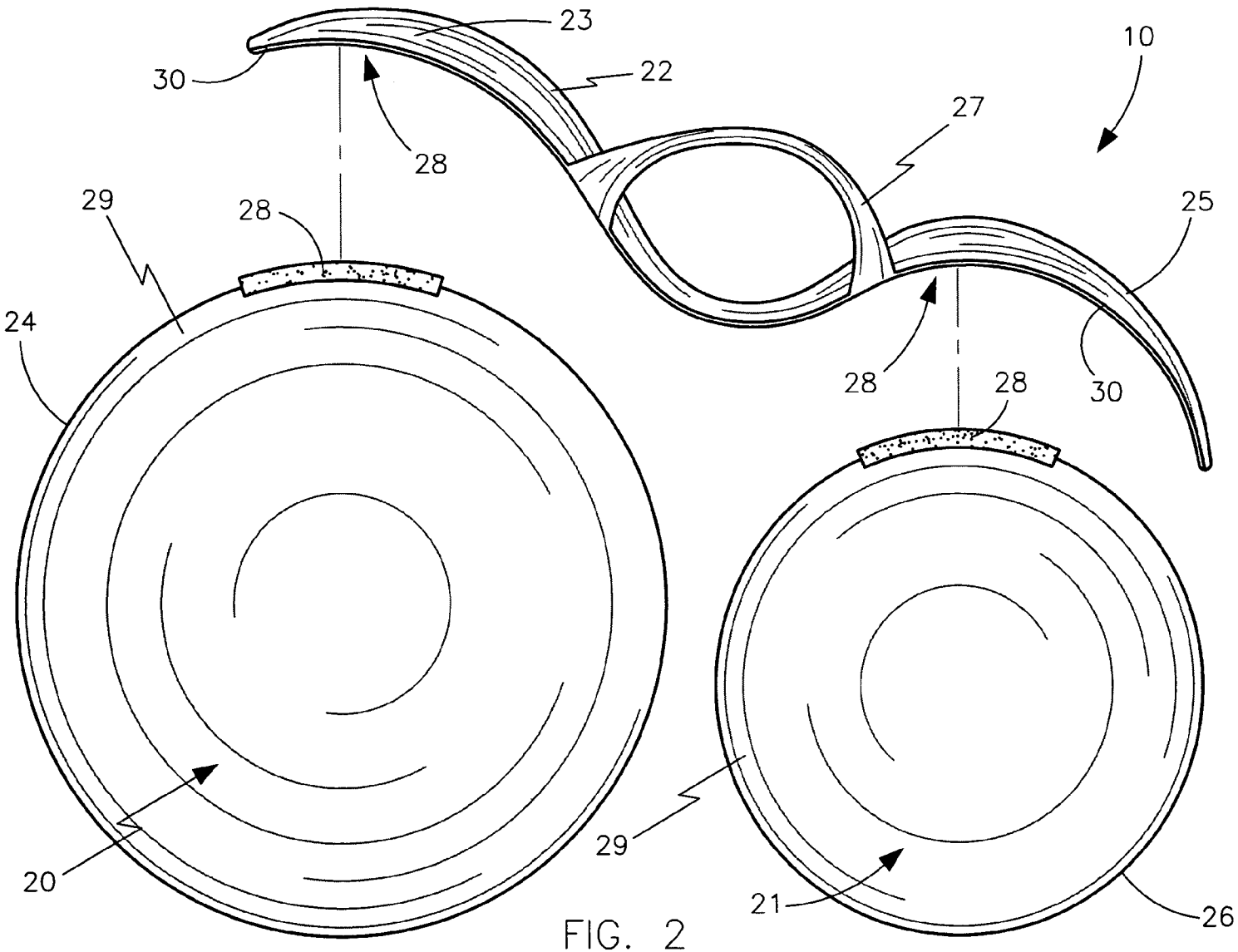
FIG. 2 is a side elevational view of the exercise and muscle toning apparatus, as seen in FIG. 1.
Figure 3A:
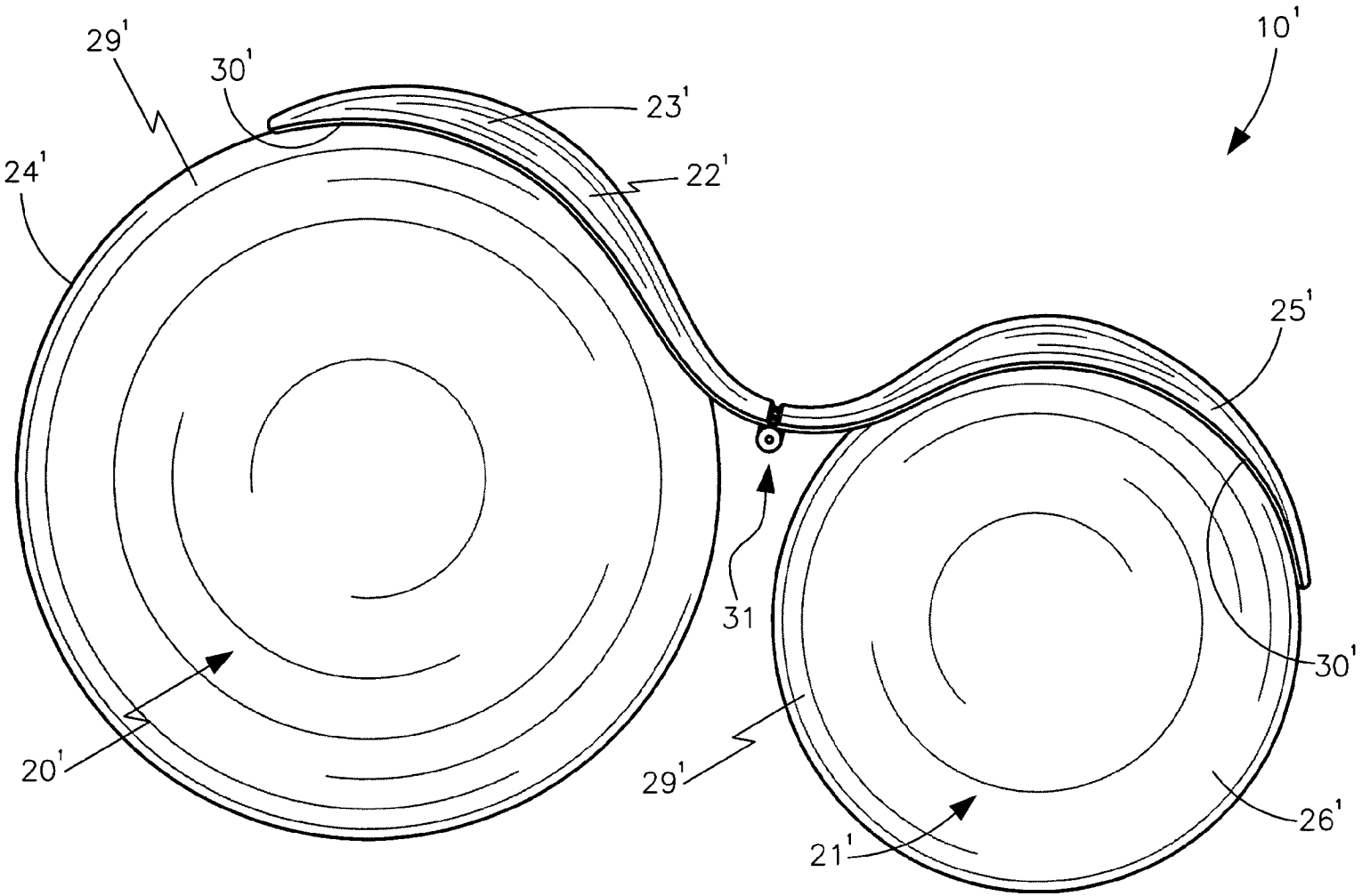
FIG. 3*a* is a side elevational view showing an alternate embodiment of the exercise and muscle toning apparatus.
Figure 3B:
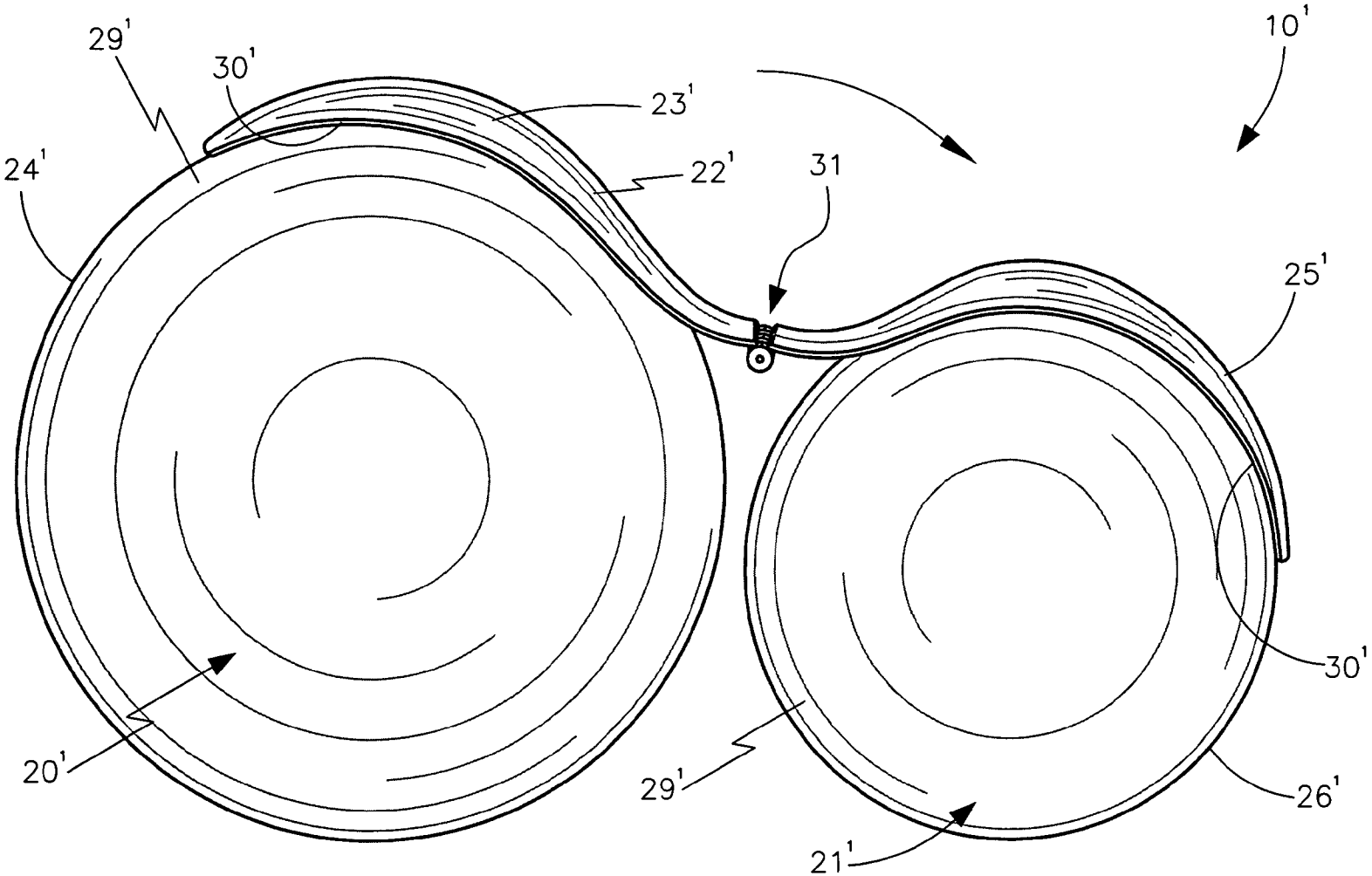
FIG. 3*b* is a side elevational view showing a reciprocating motion of the separation preventing mechanism, in accordance with the embodiment of FIG. 3*a;*
Figure 3C:
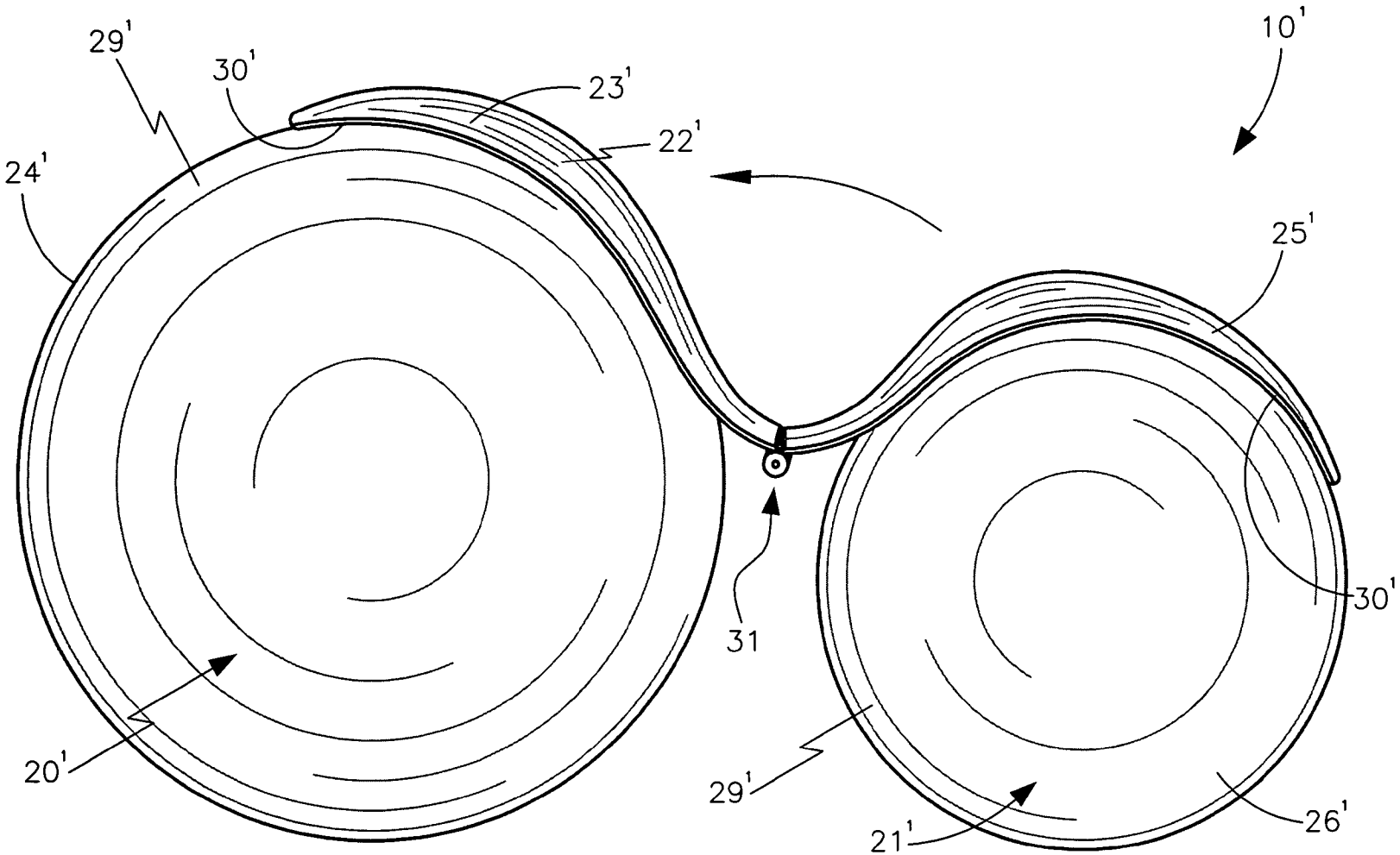
FIG. 3*c* is a side elevational view showing a reciprocating motion of the separation preventing mechanism, in accordance with the embodiment of FIG. 3*a*.
Figure 4:
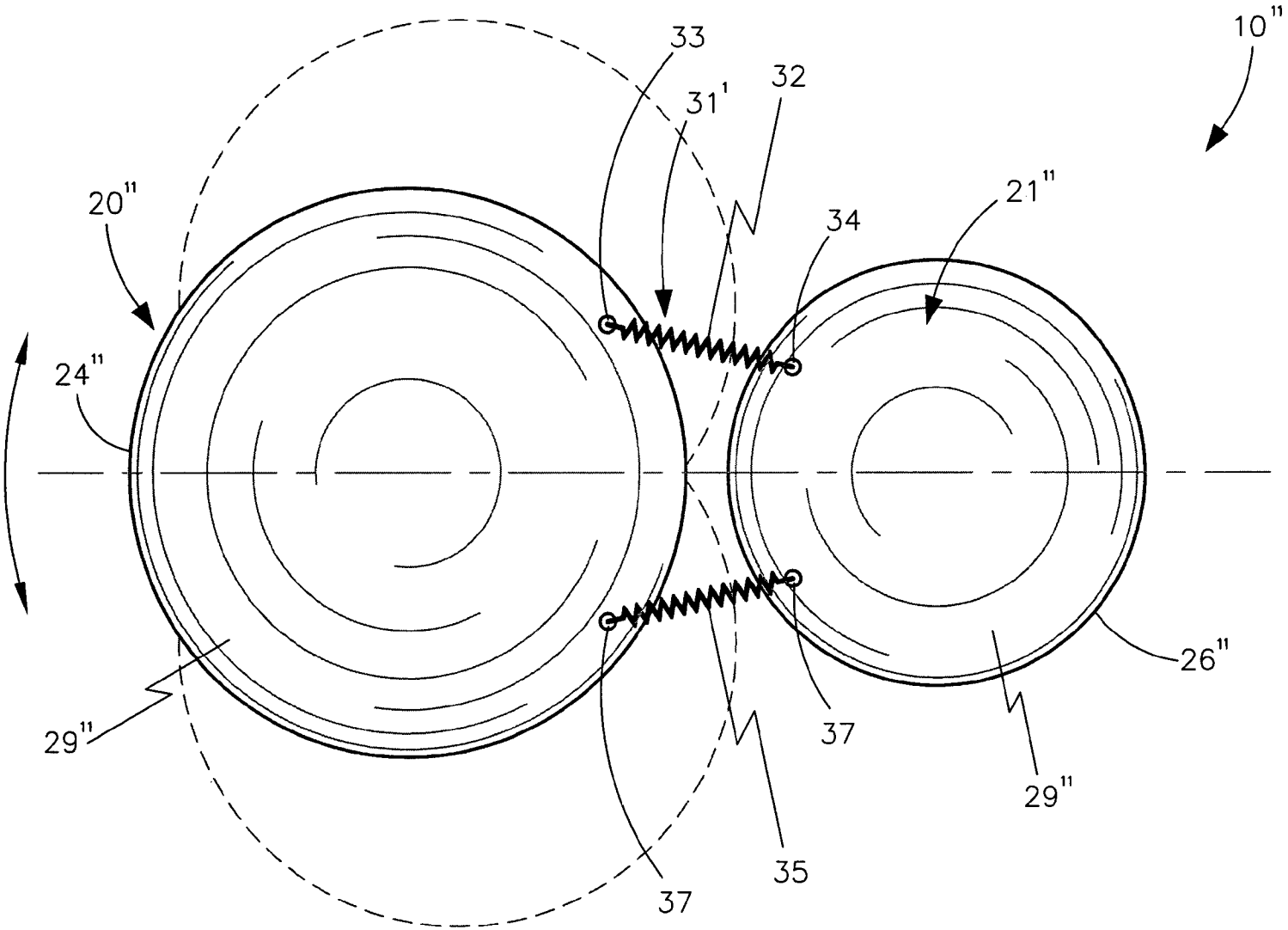
FIG. 4 is a bottom planar view showing another embodiment that employs resilient spring members attached to the balloons.

The apparatus of this invention is referred to generally in FIGS. 1-4 by the reference numeral 10, 10',10" and is intended to provide an exercise and muscle toning apparatus. It should be understood that the apparatus 10, 10', 10" may be used to tone many different muscle groups and should not be limited to toning only those muscles mentioned herein.

Referring initially to FIGS. 1, 2, 3*a*, 3*b*, 3*c* and 4, an exercise and muscle toning apparatus 10, 10', 10" includes a first inflated spherical balloon 20, 20', 20" adapted to hold a predetermined volume of air for providing resilient support, and a second inflated spherical balloon 21, 21', 21" adapted to hold a predetermined volume of air for providing resilient support. Such a second spherical balloon 21, 21', 21" has a smaller diameter than a diameter of the first spherical balloon 20, 20', 20", and the second spherical balloon 21, 21', 21" is positioned anterior of the first spherical balloon 20, 20', 20". The first and second spherical balloons may be inflated or deflated by a user in order to accommodate the apparatus during storage.

Referring to FIGS. 1, 2, 3*a*, 3*b*, 3*c* and 4, the apparatus 10 further includes a contoured chair 22, 22' adjustably and removably positioned on the first and second spherical balloons 20, 20', 20", 21, 21', 21" in such a manner that a back portion 23, 23' of the contoured chair 22, 22' conforms to a curvilinear circumference 24, 24', 24" of the first spherical balloon 20, 20', 20" while a seat portion 25, 25' of the contoured chair 22, 22' conforms to a curvilinear circumference 26, 26', 26" of the second spherical balloon 21, 21', 21". Such a chair 22, 22' further includes a plurality of handles 27 statically coupled to the back and seat portions 23, 23', 25, 25' for maintaining the back and seat portions 23, 23', 25, 25' at a fixed relationship. The back portion 23, 23' is pivotally coupled to the seat portion 25, 25', and the first and second spherical balloons 20, 20', 20", 21, 21', 21" are freely rotated on a ground surface when a user body is shifted along a tangential direction to the circumference of the first and second spherical balloons 20, 20', 20", 21, 21', 21" respectively. The chair 22, 22' enables a user to comfortably balance on the spherical balloons, thereby providing added efficiency to exercises performed by a user.

Referring again to FIGS. 1, 2, 3*a*, 3*b*, 3*c* and 4, the exercise and muscle training apparatus 10, 10', 10" further includes hook and loop fasteners 28 attached to an outer surface 29, 29', 29" of one of the first and second spherical balloons 20, 20', 20", 21, 21', 21" as well as a bottom surface 30, 30' of one of the back and seat portions 23, 23', 25, 25' of the contoured chair 22, 22' for removably attaching the contoured chair 22, 22' to the one spherical balloon 20, 20', 20", 21, 21', 21" respectively and thereby prohibiting the contoured chair 22, 22' from disengaging the one spherical balloon 20, 20', 20", 21, 21', 21". The apparatus 10 also includes a mechanism 31, 31' for preventing the first and second spherical balloons 20, 20', 20", 21, 21', 21" from separating beyond a maximum spatial distance from each other which is essential such that the first and second spherical balloons 20, 20', 20", 21, 21', 21" are automatically reciprocated towards each other after being separated beyond a threshold spatial distance. The separation preventing mechanism 31, 31' ensures that the spherical balloons do not inadvertently become separated during use of the apparatus.

Such a separation preventing mechanism 31, 31' includes a first resilient spring member 32 with first and second opposed ends 33, 34 directly coupled, without the use of intervening elements, to the outer surface 29, 29', 29" of the first and second spherical balloons 20, 20', 20", 21, 21', 21" respectively. A second resilient spring member 35 has first and second opposed ends 36, 37 directly coupled, without the use of intervening elements, to the outer surface 29, 29', 29" of the first and second spherical balloons 20, 20', 20", 21, 21', 21" respectively. Such first and second resilient spring members 32, 35 converge forwardly towards the second spherical balloon 21, 21', 21" for providing angularly offset resistive forces directed towards a center of the second spherical balloon 21, 21', 21" and thereby ensuring that a center of the second spherical balloon 21, 21', 21" is aligned with a center of the first spherical balloon 20, 20', 20" during equilibrium.

In use, the exercise and muscle toning apparatus is simple and straightforward to operate. First, the user places the chair 22 in a desired location. Next, the user simply sits on the apparatus, the same way one would sit in a normal chair. In order to perform an exercise, one simply needs to use the body to move the chair 22 in a back and forth, or side to side manner. These particular motions effectively help to increase the user's arm and leg strength, and can be repeated as many times as the user finds comfortable.

The combination of such claimed elements provides an unpredictable and unexpected result which is not rendered obvious by one skilled in the art. The present invention, as claimed, provides the unexpected and unpredictable benefit of an apparatus that is convenient and easy to use, is durable yet lightweight in design, is versatile in its applications, and provides users with a simple, low-cost, and un-encumbering means of engaging in physical activity. As a lightweight, comfortable apparatus, the present invention allows virtually any user to tone areas of their body at any time of day, advantageously without having to leave their house. Since it is extremely easy to use, busy adults are able to complete exercise regimens while sitting comfortably, achieving an optimal workout as they watch television or while simply conversing with family and friends. As a result, the portable exercise chair effectively eliminates the need for other workout regimens and trips to the gym that take up valuable time as well as money.

In use, a method for exercising and toning user muscles includes the steps of: providing a first inflated spherical balloon 20, 20', 21" adapted to hold a predetermined volume of air for providing resilient support; providing a second inflated spherical balloon 21, 21', 21" adapted to hold a predetermined volume of air for providing resilient support; positioning the second spherical balloon 21, 21', 21" anterior of the first spherical balloon 20, 20', 21"; providing a contoured chair 22, 22'; adjustably and removably positioning the chair 22, 22' on the first and second spherical balloons 20, 20', 21", 21, 21', 21" in such a manner that a back portion 23, 23' of the contoured chair 22, 22' conforms to a curvilinear circumference 24, 24', 24" of the first spherical balloon 20, 20', 21" while a seat portion 25, 25' of the contoured chair 22, 22' conforms to a curvilinear circumference 26, 26', 26" of the second spherical balloon 21, 21', 21"; a user sitting on the chair 22, 22'; the user leaning back against the back portion 23, 23'; and freely rotating the first and second spherical balloons 20, 20', 21", 21, 21', 21" on a ground surface by shifting a user body along a tangential direction to the circumference of the first and second spherical balloons 20, 20', 21", 21, 21', 21" respectively.

In use, the method further includes the step of: attaching hook and loop fasteners 28 to an outer surface 29, 29', 29" of one of the first and second spherical balloons 20, 20', 21", 21, 21', 21" as well as a bottom surface 30, 30' of one of the back and seat portions of the contoured chair 22, 22'; preventing the first and second spherical balloons 20, 20', 21", 21, 21', 21" from separating beyond a maximum spatial distance from each other; and automatically reciprocating the first and second spherical balloons 20, 20', 21", 21, 21', 21" towards each other after being separated beyond a threshold spatial distance.

In use, the method further includes the steps of: providing and directly coupling, without the use of intervening elements, first and second opposed ends 33, 34 of a first resilient spring member 32 to the outer surface 29, 29', 29" of the first and second Spherical balloons 20, 20', 21", 21, 21', 21" respectively; providing and directly coupling, without the use of intervening elements, first and second opposed ends 36, 37 of a second resilient spring member 35 to the outer surface of the first and second spherical balloons 20, 20', 21", 21, 21', 21" respectively such that the first and second resilient spring members 32, 35 converge forwardly towards the second spherical balloon 21, 21', 21"; and ensuring that a center of the second spherical balloon 21, 21', 21" is aligned with a center of the first spherical balloon 20, 20', 21" during equilibrium by providing angularly offset resistive forces directed towards a center of the second spherical balloon 21, 21', 21".

In use, the method further includes the step of: pivotally coupling the back portion 23, 23', 25, 25' to the seat portion; and providing and statically coupling a plurality of handles 27 to the back and seat portions 23, 23', 25, 25' for maintaining the back and seat portions 23, 23', 25, 25' at a fixed relationship.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An exercise and muscle toning apparatus comprising:

a first inflated spherical balloon adapted to hold a predetermined volume of air for providing resilient support;

a second inflated spherical balloon adapted to hold a predetermined volume of air for providing resilient support, said second spherical balloon having a smaller diameter than a diameter of said first spherical balloon, said second spherical balloon being positioned anterior of said first spherical balloon; and a contoured chair positioned on said first and second spherical balloons in such a manner that a back portion of said contoured chair conforms to a curvilinear circumference of said first spherical balloon while a seat portion of said contoured chair conforms to a curvilinear circumference of said second spherical balloon;

wherein said first and second spherical balloons are freely rotated on a ground surface when a user body is shifted along a tangential direction to said circumference of said first and second spherical balloons respectively;

hook and loop fasteners attached to an outer surface of one of said first and second spherical balloons as well as a bottom surface of one of said back and seat portions of said contoured chair for removably attaching said contoured chair to said one spherical balloon respectively and thereby prohibiting said contoured chair from disengaging said one spherical balloon.

2. The exercise and muscle training apparatus of claim 1, further comprising: means for preventing said first and second spherical balloons from separating beyond a maximum spatial distance from each other such that said first and second spherical balloons are automatically reciprocated towards each other after being separated beyond a threshold spatial distance.

3. The exercise and muscle training apparatus of claim 2, wherein said separation preventing means comprises:

a first resilient spring member having first and second opposed ends directly coupled to said outer surface of said first and second spherical balloons respectively; and a second resilient spring member having first and second opposed ends directly coupled to said outer surface of said first and second spherical balloons respectively;

wherein said first and second resilient spring members converge forwardly towards said second spherical balloon for providing angularly offset resistive forces directed towards a center of said second spherical balloon and thereby ensuring that a center of said second spherical balloon is aligned with a center of said first spherical balloon during equilibrium.

4. The exercise and muscle training apparatus of claim 1, wherein said back portion is pivotally coupled to said seat portion.

5. The exercise and muscle training apparatus of claim 1, wherein said chair further comprises: a plurality of handles statically coupled to said back and seat portions for maintaining said back and seat portions at a fixed relationship.

6. An exercise and muscle toning apparatus comprising:

a first inflated spherical balloon adapted to hold a predetermined volume of air for providing resilient support;

a second inflated spherical balloon adapted to hold a predetermined volume of air for providing resilient support, said second spherical balloon having a smaller diameter than a diameter of said first spherical balloon, said second spherical balloon being positioned anterior of said first spherical balloon; and a contoured chair adjustably and removably positioned on said first and second spherical balloons in such a manner that a back portion of said contoured chair conforms to a curvilinear circumference of said first spherical balloon while a seat portion of said contoured chair conforms to a curvilinear circumference of said second spherical balloon;

wherein said first and second spherical balloons are freely rotated on a ground surface when a user body is shifted along a tangential direction to said circumference of said first and second spherical balloons respectively;

hook and loop fasteners attached to an outer surface of one of said first and second spherical balloons as well as a bottom surface of one of said back and seat portions of said contoured chair for removably attaching said contoured chair to said one spherical balloon respectively and thereby prohibiting said contoured chair from disengaging said one spherical balloon.

7. The exercise and muscle training apparatus of claim 6, further comprising: means for preventing said first and second spherical balloons from separating beyond a maximum spatial distance from each other such that said first and second spherical balloons are automatically reciprocated towards each other after being separated beyond a threshold spatial distance.

8. The exercise and muscle training apparatus of claim 7, wherein said separation preventing means comprises:

a first resilient spring member having first and second opposed ends directly coupled to said outer surface of said first and second spherical balloons respectively; and a second resilient spring member having first and second opposed ends directly coupled to said outer surface of said first and second spherical balloons respectively;

wherein said first and second resilient spring members converge forwardly towards said second spherical balloon for providing angularly offset resistive forces directed towards a center of said second spherical balloon and thereby ensuring that a center of said second spherical balloon is aligned with a center of said first spherical balloon during equilibrium.

9. The exercise and muscle training apparatus of claim 6, wherein said back portion is pivotally coupled to said seat portion.

10. The exercise and muscle training apparatus of claim 6, wherein said chair further comprises: a plurality of handles statically coupled to said back and seat portions for maintaining said back and seat portions at a fixed relationship.

* * * * *